US007900297B2

(12) United States Patent
Peng

(10) Patent No.: US 7,900,297 B2
(45) Date of Patent: Mar. 8, 2011

(54) MOVABLY AUXILIARY SANITARY CARE APPARATUS

(76) Inventor: Shao-Yu Peng, Huatan Shiang (TW)

( * ) Notice: Subject to any disclaimer, the term of this patent is extended or adjusted under 35 U.S.C. 154(b) by 541 days.

(21) Appl. No.: 11/953,817

(22) Filed: Dec. 10, 2007

(65) Prior Publication Data

US 2009/0144891 A1 Jun. 11, 2009

(51) Int. Cl.
*A47K 13/10* (2006.01)

(52) U.S. Cl. ..... 4/667; 4/444; 4/480; 297/DIG. 10

(58) Field of Classification Search ..... 4/667, 111.1, 4/471–486; 297/DIG. 10, 344.19, 344.13, 297/423.44
See application file for complete search history.

(56) References Cited

U.S. PATENT DOCUMENTS 4,761,837 A * 8/1988 Takeda ..... 4/443
5,058,222 A * 10/1991 Workman et al. ..... 5/605
5,161,812 A * 11/1992 DeWeese ..... 280/47.38
5,189,739 A * 3/1993 Thierry ..... 4/254
6,009,570 A * 1/2000 Hargest et al. ..... 4/449
6,112,338 A * 9/2000 Sundberg ..... 4/449
6,507,961 B1 * 1/2003 Ming-Hwa ..... 4/667
7,287,286 B2 * 10/2007 Lee ..... 4/420.4

* cited by examiner

*Primary Examiner* — Gregory Huson
*Assistant Examiner* — Janie Christiansen
(74) *Attorney, Agent, or Firm* — Chun-Ming Shih

(57) ABSTRACT

A movable auxiliary sanitary care apparatus includes a support unit, a lifting unit, a water supply unit, a control unit built in the outer shell unit to modulate and control water temperature and warm temperature of the seat cushion and the extension and retraction of the cleaning nozzle unit, a waste storing unit and a riding unit having a seat cushion and an outer lid. The seat cushion warms up the user's hip after the user is seated. The water supply unit is driven by the control unit via the control panel of the outer shell unit to clean the anal part of the user directly after evacuation to have the waste solely collected in the waste storing unit. The apparatus has the additional convenient function that the lifting unit can lifts the seat cushion gradually to help push the user to stand up from the seat cushion after evacuation.

15 Claims, 11 Drawing Sheets

MOVABLY AUXILIARY SANITARY CARE APPARATUS

BACKGROUND OF THE INVENTION

1. Field of the Invention

The present invention relates to a movable sanitary care auxiliary device system, particularly to a movable toilet chair, which can pump clean water from a built-in reservoir container to a water supply tank and enable user to modulate and control the temperature of the water supply tank and seat temperature. After the user evacuates, the cleaning nozzle unit is manipulated to extend, retract and clean by a control unit. The user's waste and waste water are stored by a waste storing unit provided with monitoring and warning of the level of the waste liquid to achieve the requirements of easy manipulation, hygiene and health for a movable toilet chair.

2. Description of the Prior Art

The conventional movable toilet chair is provided with a toilet cover horizontally on an exposed metal frame for hip sitting and pivoted with a liftable toilet lid on the toilet cover and installed with a collecting bucket below the toilet seat.

Due to the members applied in the conventional toilet chair are directly connected with the collecting bucket below the toilet cover, the user's waste are easy stained on user's hip for dropping on the collecting bucket directly. Additionally, the waste are not monitored and processed and the foul odor of the waste further affects environmental air quality. Furthermore, after the user evacuates the user cannot sit down, stand up or wipe and clean by self for handicapped reason. The user will have to rely on others' support to wipe and clean. It will cause the inconvenience of others and derogate the user's self esteem.

Due to the toilet seat of the conventional toilet chair is not designed ergonomically but solves the problem of temporarily collecting the user's waste. The conventional toilet chair is displayed in dull and frigid. Not only it is unstable in support but also the direct contact of the cold toilet seat will cause the user to feel tremble and uncomfortable.

However, the conventional toilet chair is not provided with any additional function. The user not only cannot stand up by self but also the helper has to hold the user laboriously and wipe the anal part of the user while the user is in the state of standing after the user evacuates. It often causes the user to feel uncomfortable and psychological burden due to the helper does not clean thoroughly and is the user may be infected by germs accordingly.

Furthermore, the abovementioned conventional toilet chair is designed by the temporary need of evacuation, its function at most works to receive the waste of the user. Therefore, it can not compare with the toilet in the restroom in use. If the waste is not cleaned immediately after evacuating there will be a problem of foul odor spread and affects air quality inside the space.

In viewing of the abovementioned problems, the inventor of the present invention endeavors to improve and successfully invents the movable sanitary care auxiliary device system of the present invention after years of research.

SUMMARY OF THE INVENTION

The objective of the present invention is to provide a movable auxiliary toilet chair with an independent reservoir container which is installed with a liquid level detection device to measure and monitor the level of clean water continuously.

Another objective of the present invention is to provide a movable auxiliary toilet chair with a control unit powered by an independent power supply which the control unit modulates the cleaning nozzle unit to output water from the water supply tank to clean the anal part of the user or drives a heating device to heat the cleaning water of the water supply tank.

A further objective of the present invention is to provide a movable auxiliary toilet chair with a waste storing unit which stores the waste independently after the user evacuates.

A yet further object of the present invention is to provide a movable auxiliary toilet chair with a control unit driven by an independent power supply which modulates the culture microorganism alone to put them into the waste storing unit after the user evacuates and enables the culture microorganism to flow with the water into the waste storing unit to decompose the waste and foul odor.

A movable auxiliary sanitary apparatus achieving the abovementioned objectives comprises:

a supporting unit which forms a storing space by frame;

a riding unit on which a user is seated;

a lifting unit which is combined with the riding unit to drive the riding unit to descend or ascend with varying angles to support the user to sit on or stand up from the riding unit;

a water supply unit which ejects water to clean an anal part of the user after the user evacuates;

a waste storing unit which collects and stores the waste.

BRIEF DESCRIPTION OF THE DRAWINGS

The drawings disclose an illustrative embodiment of the present invention which serves to exemplify the various advantages and object hereof, and are as follows.

DETAILED DESCRIPTION OF THE PREFERRED EMBODIMENT

Figure 1:
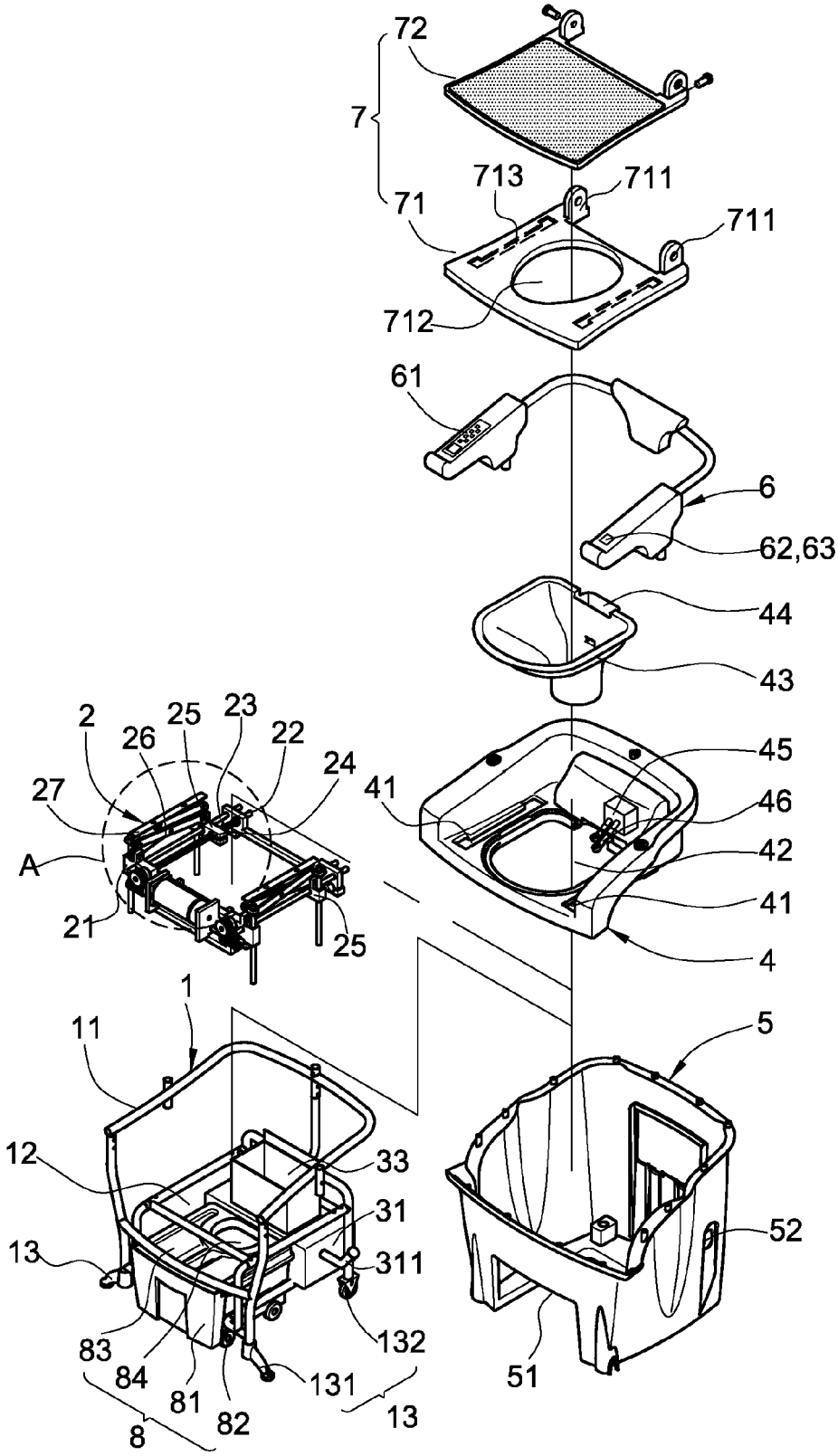
FIG. 1 is an exploded view of a movable auxiliary sanitary care apparatus of the present invention.
Figure 2:
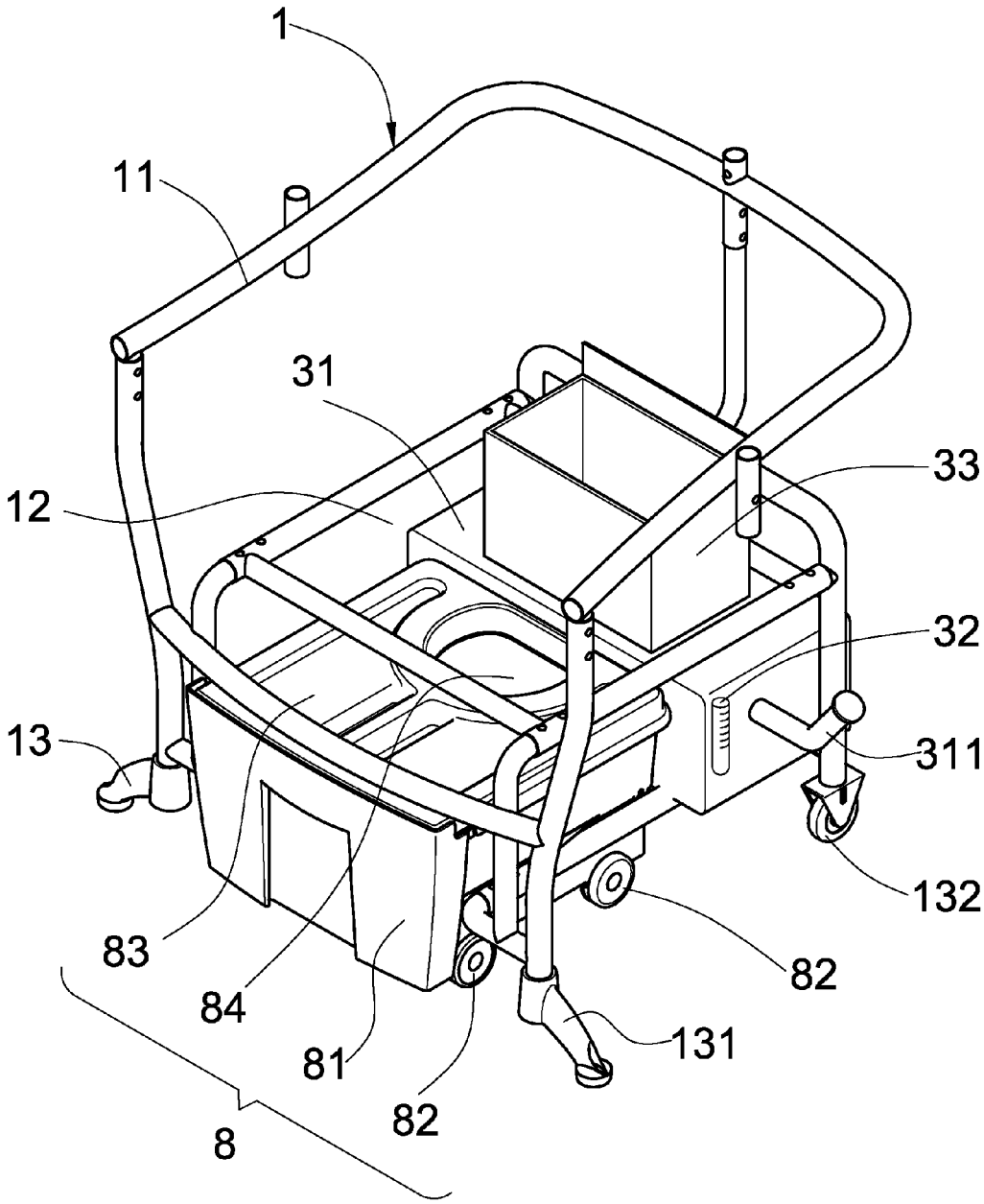
FIG. 2 is a schematic structural view of a water supply unit and a waste storing unit installed at a supporting unit.

First, referring to FIG. 1 which is an exploded view of a movable auxiliary sanitary apparatus of the present invention, the apparatus comprises the following. components As shown in FIG. 2, a supporting unit 1 comprised by an integral frame consists of an armrest section 11, a storing space 12, a combination positioning post 131, and a chair leg section 13 of rotating wheels 132 to stably support the toilet chair.

Figure 4:
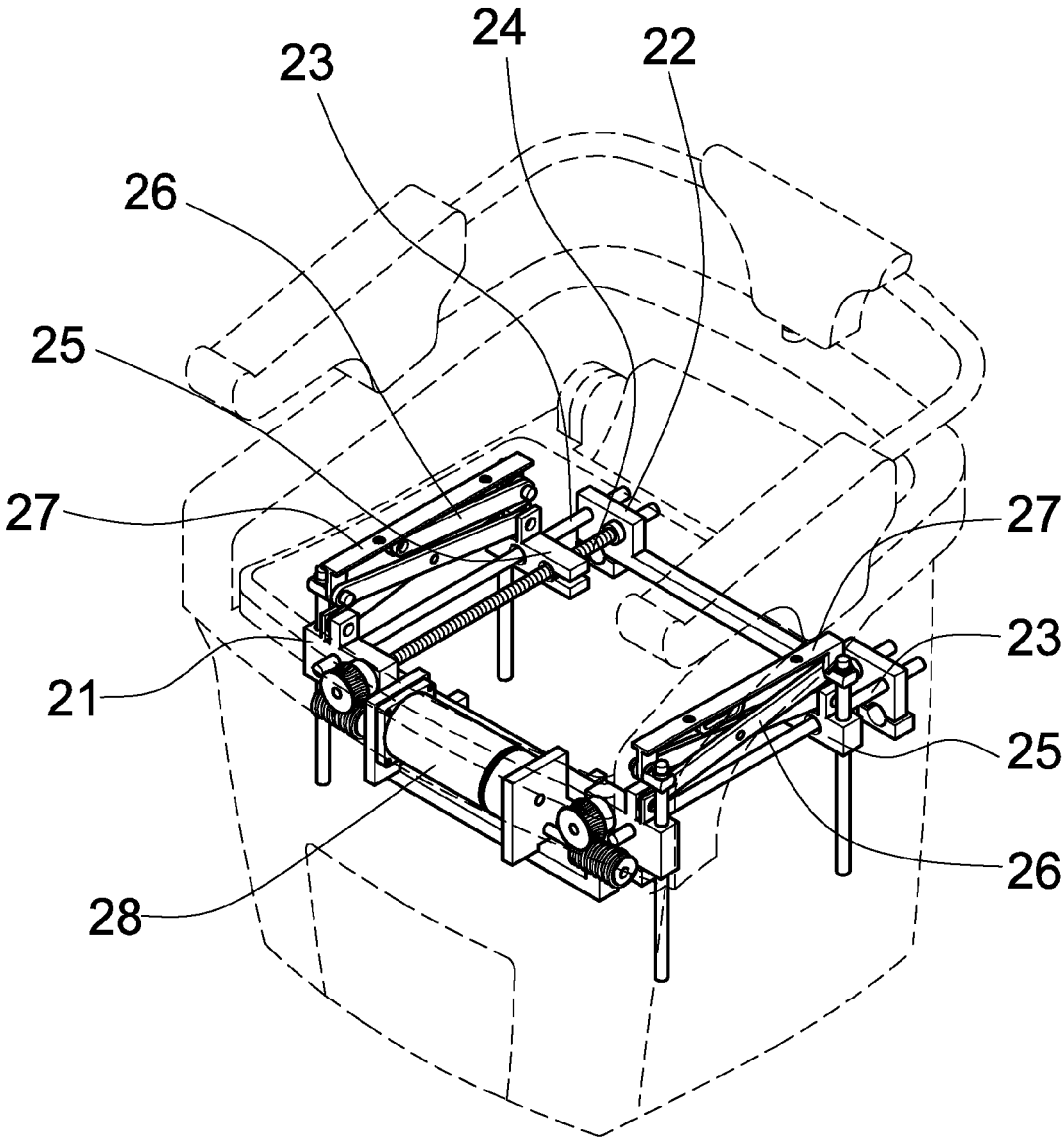
FIG. 4 is a schematic structural view of a lifting unit installed in a supporting unit.
Figure 5:
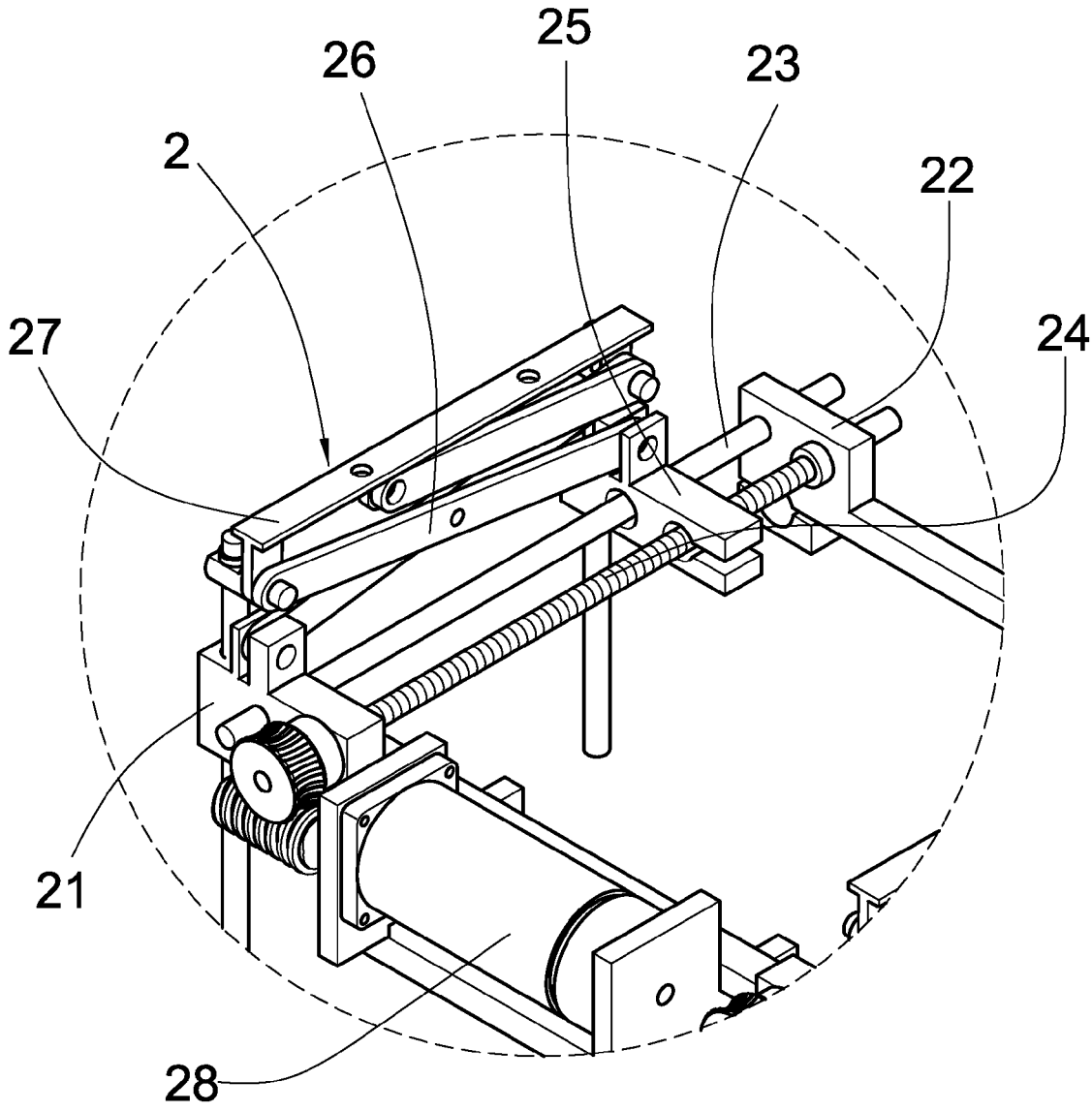
FIG. 5 is an enlargement view of a local structure of a lifting unit of the present invention.
Figure 10:
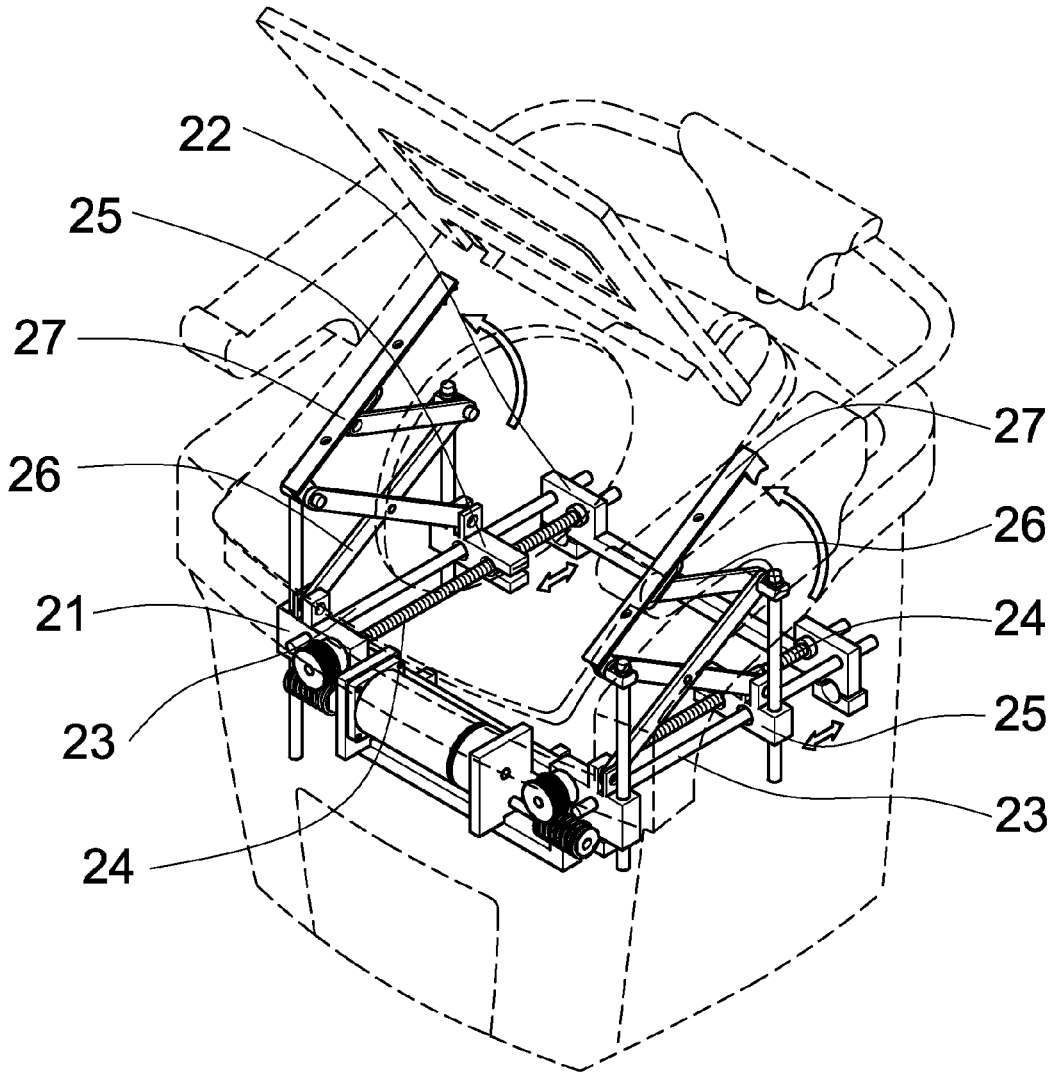
FIG. 10 is a schematic view of a toilet chair in lifting action.
Figure 11:
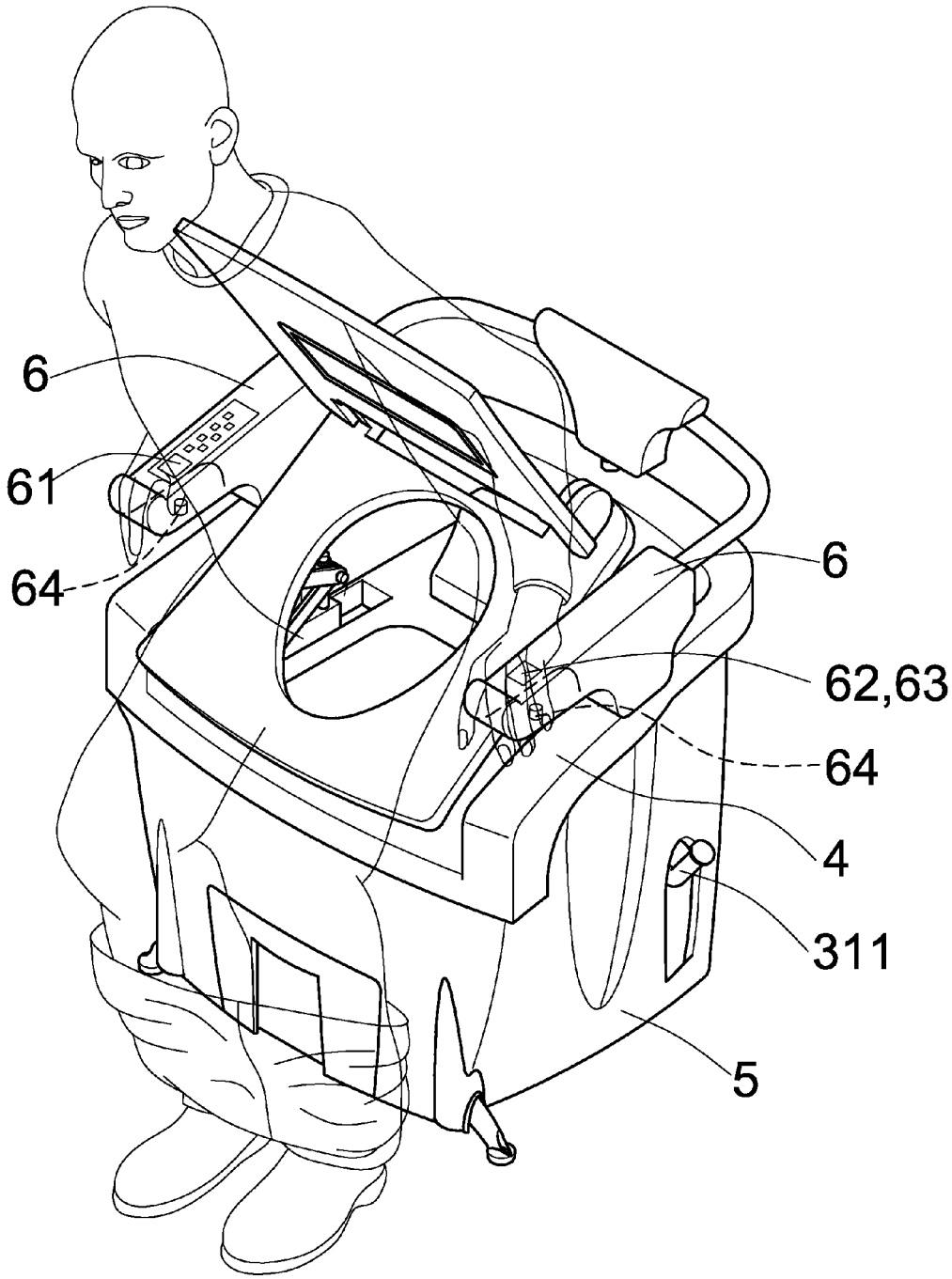
FIG. 11 is a schematic view of a toilet chair after use.

As shown in FIG. 4 and FIG. 5, a lifting unit 2 is actuated via a control panel 61 of a third shell body 6 by the user after the user evacuates and comprises a front fixing bracket 21 and a rear fixing bracket 22 which crosses the supporting unit 1, a balance rod 23 and a driving rod 24 which are installed between the front fixing bracket 21 and rear fixing bracket 22, a power source 28 connecting with the driving rod 24 (which can be connected with a central processing unit), a movable member 25 installed between the balance rod 23 and driving rod 24, a lever unit 26 and a pushing member 27 which both are crossed and pivoted each other at the front fixing frame 21 and the movable member 25 to drive the movable member 25 to move along the driving rod 24 in forward and backward movement after the driving rod 24 is driven and rotated by the power source 28. The lever unit 26 is moved in ascending or descending along with the variation of the position of the movable member 25 and the pushing member 27 is respectively ascended or descended gradually. The lever unit 26 is controlled in synchronization to move upward to become a rising sloped state. At the same time the pushing member 27 secured with a seat 71 is driven upward gradually to assist the user to stand up (as shown in FIG. 10 and FIG. 11).

Figure 6:
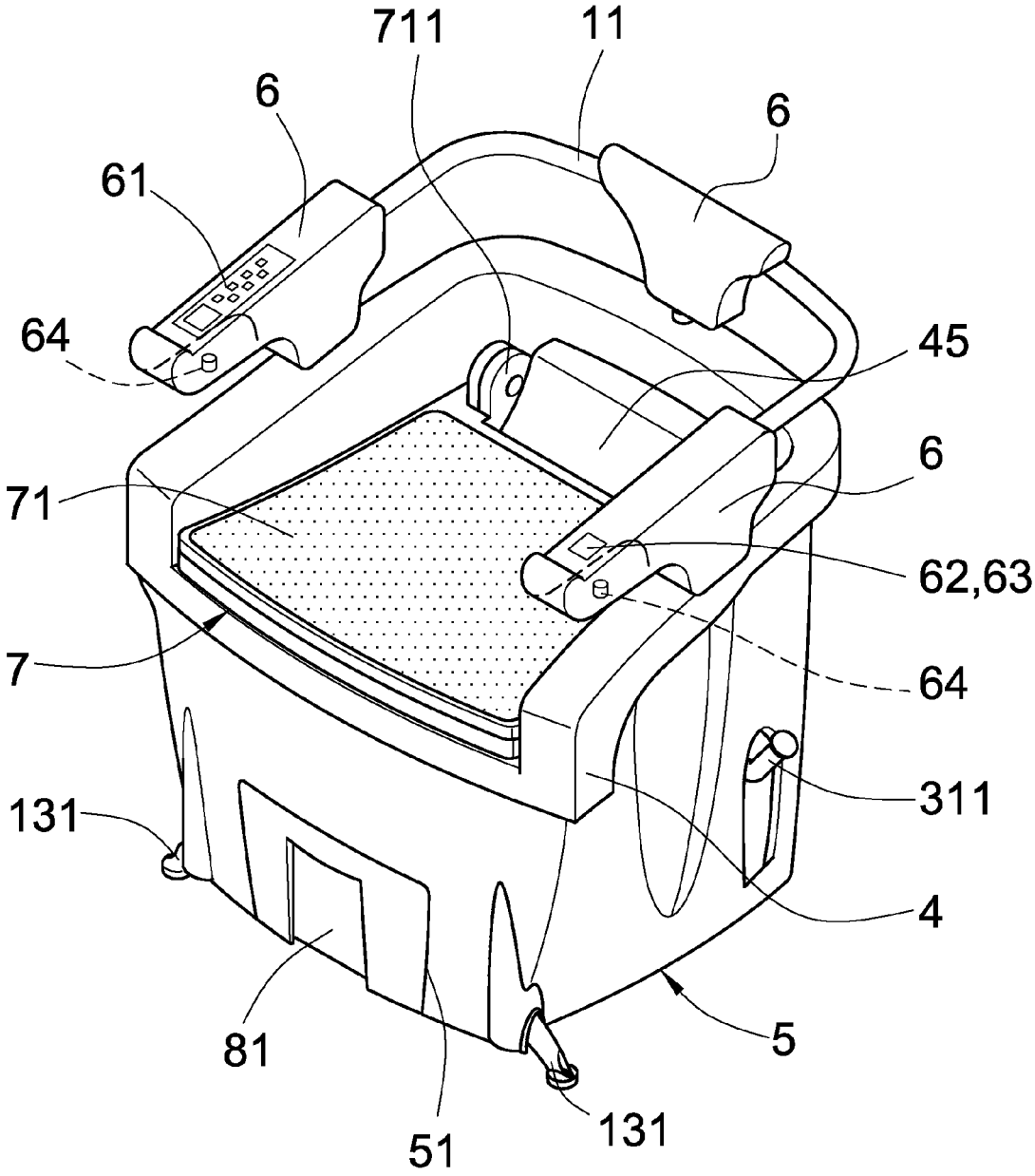
FIG. 6 is a perspective outer appearance view of a toilet chair of the present invention.

As shown in FIG. 6, the control panel 61 of the third shell body 6 is provided with an emergency switch 62 and a restoring switch 63. When the user loses his strength or balance while he stands up from the seat 71 he can push the emergency switch 62 to switch off the power supply of the control unit 45 to stop the action of the lifting unit 2. Afterward the restoring switch 63 is pushed to restore the electric power to lower down the lever unit 26 after the emergency switch 62 is switched off. The emergency switch 62 and the restoring switch 63 can be installed independently. Alternatively, they can be combined in one switch which it can be programmed with the function to actuate the emergency switch 62 when it is pushed in 1~2 seconds and actuate the restoring switch 63 when it is pushed in 3~5 seconds to make the lifting unit 2 going down to become a horizontal collected state when it is not in use.

A water supply unit comprises a reservoir container 31 provided with a water intake section 311 to hold the required clean water from the water intake section 311; a liquid level detection device 32 installed inside the reservoir container 31 to measure and monitor the liquid level of the cleaning water continuously, which can be a capacitance detection device so that when the liquid level of the clean water is changed, the covered area between the inner and exterior electrodes is changed accordingly to cause the variation of the capacitance value and a verification signal is thus generated and amplified by a built-in amplifier and transmitted to a control unit 45 and then to the control panel 61; a water supply tank 33 connected to a reservoir container 31 with tubes; a pumping device (not shown) installed on the tubes extended from the reservoir container 31 and controlled by the control unit 45, which can pump the clean water of the reservoir container 31 to the water supply tank 33; a water supply device (not shown) installed on the tubes extended from the water supply tank 33, which it is connected with a cleaning nozzle unit 46 to adjust the water pressure outputting to the cleaning nozzle unit 46.

Figure 3:
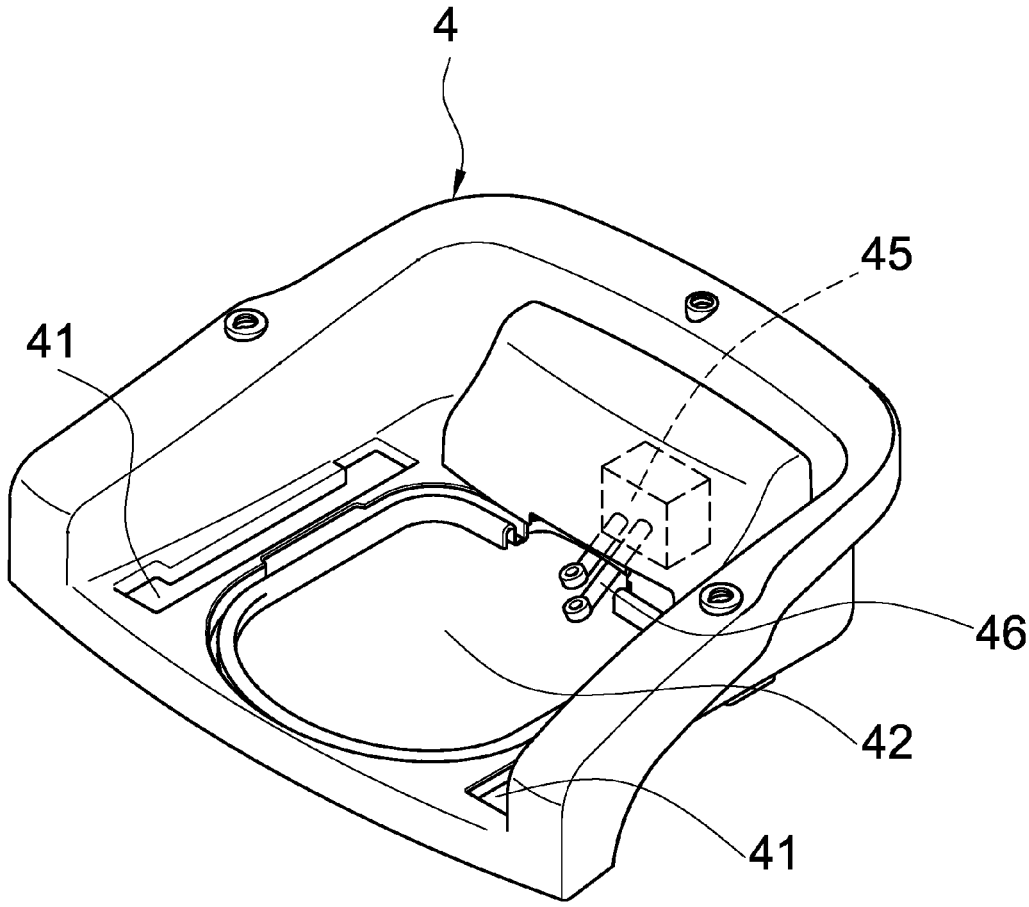
FIG. 3 is a schematic perspective view of a first shell body.

An outer shell unit comprises a first shell body 4 which provides cover on the top of the supporting unit 1. The first shell body 4 is provided with two slots 41 and an aperture 42. The slots 41 are used to accommodate the pushing member 27 of the lifting unit 2 and the aperture 42 is used to install a hollow guiding basin body 43. The guiding basin body 43 is provided with a slide path 44 flowing toward the inner side and is coated with nano grade coating on surface to diminish the residue of waste stain. As shown in FIG. 3, the first shell body 4 is provided with a control unit 45 at its interior surface, which is driven by a power supply and comprised by a central processing unit, the cleaning nozzle unit 46 having a germicide light source, a heating device (not shown), a cleaning device (not shown) and a beeper (not shown). The cleaning nozzle unit 46 is connected to the water supply tank 33 with tubes. The heating device is installed on the tubes extended from the reservoir container 31 or installed inside the water supply tank 33 to heat the clean water of the water supply tank 33. The cleaning device puts the culture microorganism into the guiding basin body 43 to have the culture microorganism flow with water into the waste-storing unit 8 to decompose the waste and the foul odor of the waste when the cleaning nozzle unit 46 is used. The beeper (not shown) provides the function of warning sound when the clean water of the reservoir container 31 has reached the lower limit value or the waste or waste water of the waste storing unit 8 has reached the upper limit value. The cleaning nozzle unit 46 is provided with a hole shaped slide path 44 which flows toward the inner side of the guiding basin body 43 on the top corresponding with the aperture 42 in cooperation with the guiding basin body 43 to let the residual water drops flow into the guiding basin body 43 from the hole shaped slide path 44 after the nozzle rod of the cleaning nozzle unit 46 is used and retracted.

The outer shell unit further comprises a second shell body 5 covering the lower part of the support unit 1, which is provided with an opening 51 from the front rim and an through hole 52 on a lateral surface to have the water intake section of the reservoir container 31 extending out of the exterior surface of the shell body.

A third shell body 6 of the outer shell unit comprises covering the armrest section 11 of the support unit 1 is provided with a control panel 61 connecting with a control unit 45, an emergency switch 62, a restoring switch 63 and two start switches 64. The control panel 61 drives the central processing unit to control the temperature of the water supply tank 33, modulates and controls the later mentioned seat cushion 71 to have the warm effect, and the movements of the cleaning nozzle unit 46 to extend, retract and clean, and monitors and warns the liquid level of clean water and liquid level of the waste of the later mentioned waste storing unit 8. The emergency switch 62 cuts off the power supply in emergency and the restoring switch 63 restores the electricity immediately to lower down the level unit 26 after the emergency switch 62 cuts off the power supply in emergency. The start switches 64 are installed below the armrest section 11, which can drive the movable member 25 to move horizontally in forward and backward on the driving rod 24 via the power source 28 connecting with the central processing unit. The reason for adopting two sets of design for the start switches 64 is considering that when in use both hands of the user function well, the user can exert an opposite force on the armrest section 11 to get out of the chair by self after the lifting unit ascends/descends the seat.

A riding unit 7 comprises a seat cushion 71 which is provided with a pivotal section 711 at the rear corresponding with the control unit 45 and forms an opening 712 where corresponds with the top of the guiding basin body 43 and a location restraining section 713 corresponding with the pushing member 27 of the lifting unit 2 on the lower surfaces of both sides are provided to have the pushing member 27 accommodated and restrained therein. When the lifting unit 2 undergoes the lifting movements it drives the lifting of the seat cushion 71 likewise. The seat cushion 71 is provided with a temperature keeping member at the inner rim and connected with the heating device. The seat cushion 71 modulates the control panel 61 to control the temperature keeping member inside the seat cushion to produce warm temperature depending on the requirement of the user.

An outer lid 72 of the riding unit is pivoted with the pivotal section 711 of the seat cushion 71 and combined with the seat cushion as an integral. Its upper surface can be first provided with foam rubber then covered with soft fabric, plastic leather or leather or other material to combine with the seat cushion 71 to work as a conventional chair when the toilet chair is not in use.

A waste storing unit 8 is comprised by a box body 81 and a lid body 83. The bottom of the box body 81 is provided with plural rolling wheels 82 to move and take conveniently. The lid body 83 closes the top of the box body 81 and forms a slot 84 corresponding with the lower part of the guiding basin body 43 to have the waste collect in the box body 81 via the slot 84 of the lid body 83 when the waste falls from the opening 712 of the seat cushion 71 toward the guiding basin body 43. Furthermore the box body 81 can be provided with a liquid level detection device (not shown) connecting with the control unit 45 to measure and monitor the liquid level of the waste and wastewater. If the waste and waste water inside the box body 81 reaches the upper limit value, the control unit 45 will sound or transmit warn signal to the control panel 61 with a beeper. At the same time the pumping device, the water supply device and the heating device will be turned off to prevent the waste and wastewater from spilling over the box body 81.

Figure 7:
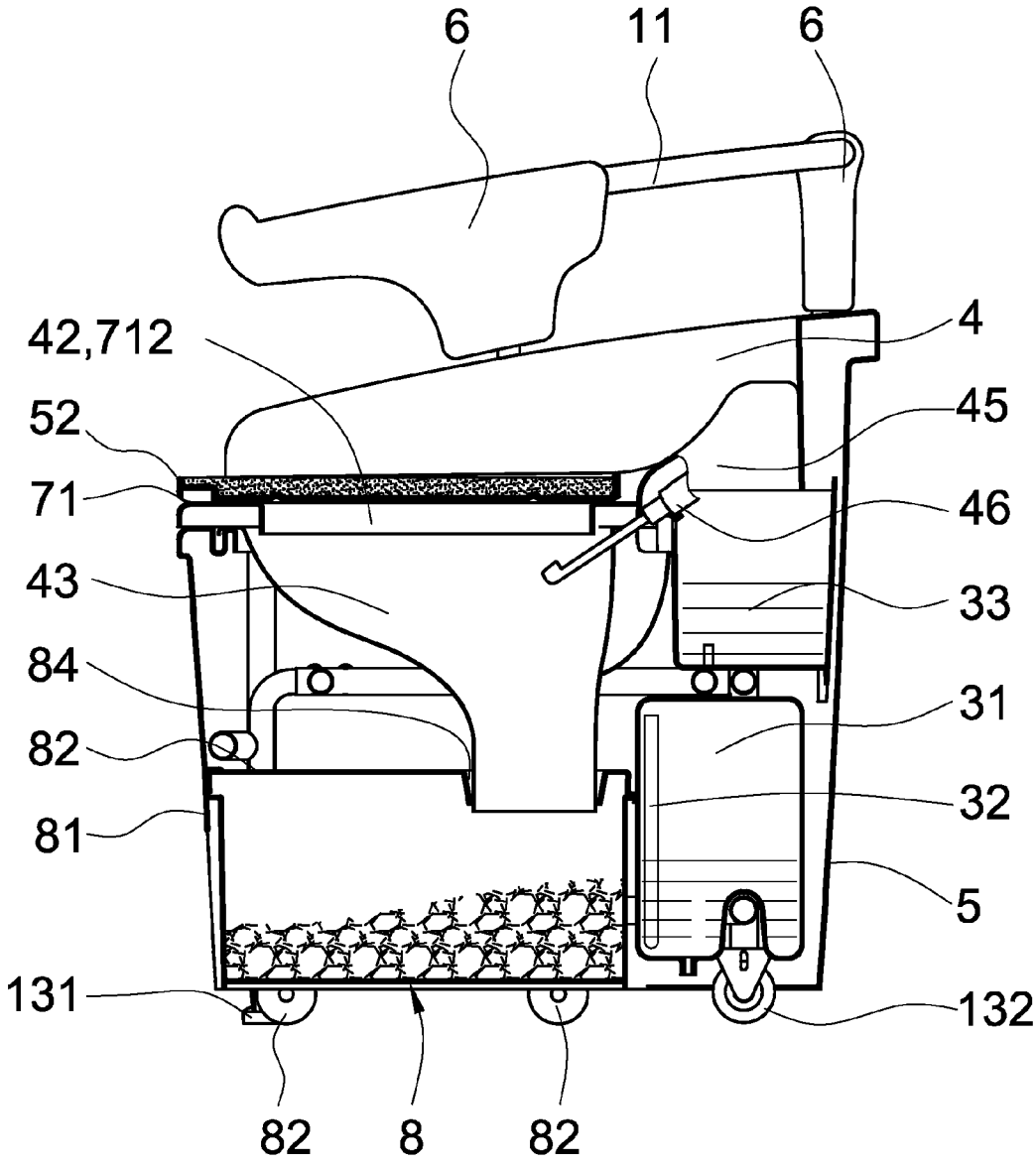
FIG. 7 is a cross-sectional view of the outer appearance of a toilet chair assembly of the present invention.

Furthermore, referring to FIG. 6 and FIG. 7, they are the outer appearance and cross-sectional views of the movable auxiliary sanitary care apparatus assembly of the present invention. When the structure of the movable auxiliary sanitary care apparatus assembly of the present invention is assembled, the water supply tank 33 and the reservoir container 31 are first installed below the storing space 12 of the support unit 1 neighboring the rolling wheels 132 and then have the second shell body 5 of the outer shell unit cover the exterior of the storing space 12 of the support unit 1. The opening 51 of the second shell body 5 of the outer shell unit is placed with a movable waste storing unit 8. Then the lifting unit 2 is placed across both sides of the storing space 12 of the support unit 1 with the front fixing frame 21 and the rear fixing frame 22 to have the lifting unit 2 positioned on the support unit 1 stably. At this moment the power source controlling the lifting unit 2 is installed on the front fixing frame 22 and have the output end of the power source connected with the input end of the driving rod 24 installed between the front fixing frame 21 and rear-fixing frame 22 to form a linkage relation.

Next the first shell body 4 of the outer shell unit is covered on the top of the support unit 1 to have both slots 41 of the first shell body 4 exactly restrained at the location to be supported or collected by the pushing members 27 at both sides of the lifting unit 2. Then the guiding basin body 43 is positioned on the top of the slot 84 of the lid body 83 of the waste-storing unit 8 from the central aperture 42.

Next the armrest section 11 of the support unit 1 of the third shell body 6 is covered. Finally the seat cushion 71 and the outer lid 72 of the riding unit 7 are pivoted together as an integral in advance. The bottom of the seat cushion 71 is covered on the top of the first shell body 4 correspondingly. The location restraining sections 713 at both sides of the bottom of the seat cushion 71 are exactly corresponded with the pushing members 27 of the lifting unit 2. At this moment the location restraining sections 713 of the seat cushion 71 and the pushing member 27 of the lifting unit 2 are secured and assembled. At this moment the pivotal locations of the seat cushion 71 and the outer lid 72 are exactly at both sides of the control unit 45 of the first shell body 4.

Figure 8:
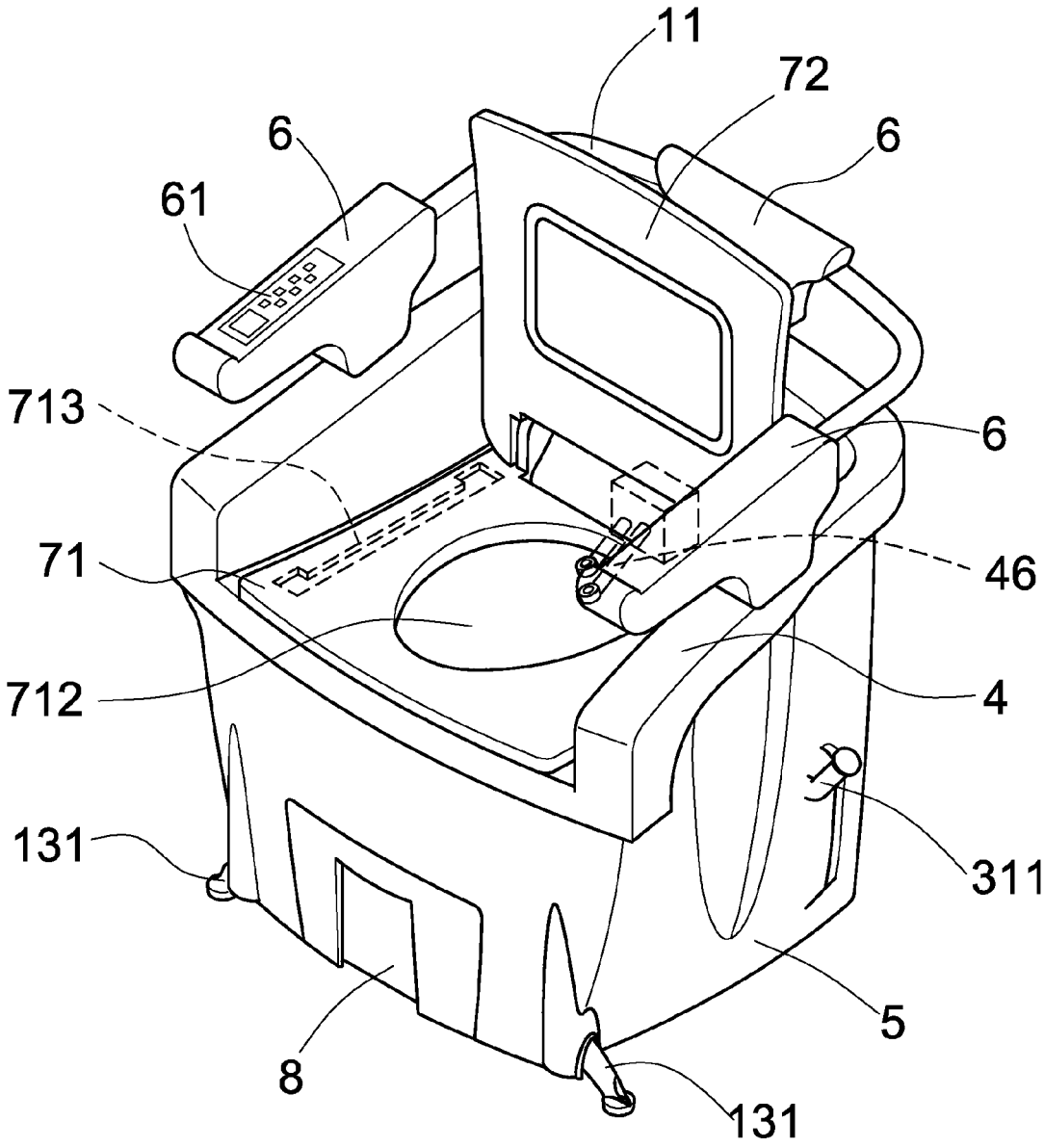
FIG. 8 is a schematic view of a toilet chair not in use.
Figure 9:
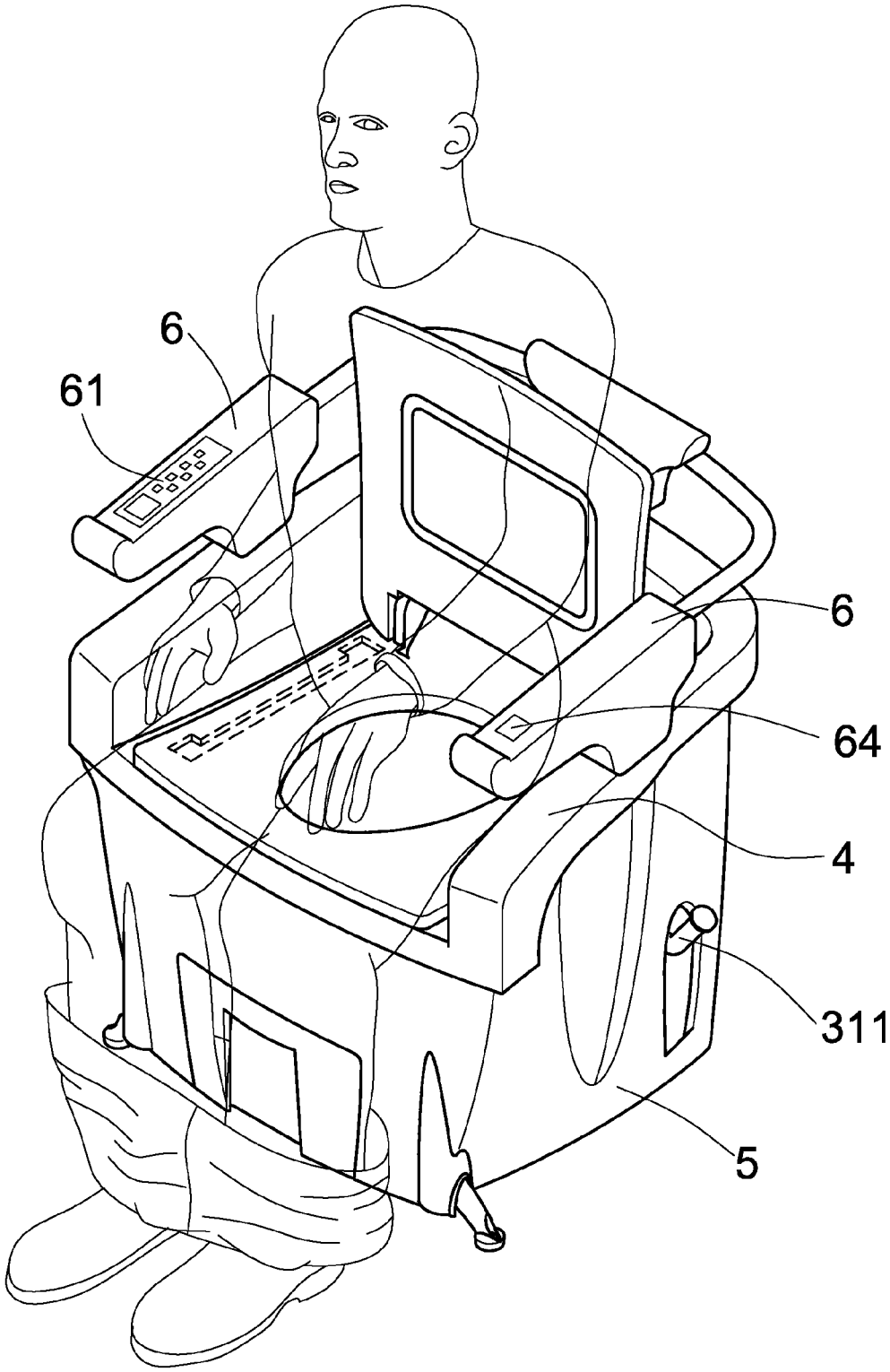
FIG. 9 is a schematic view of a toilet chair in use.

Furthermore, referring to FIG. 8, FIG. 9 they are schematic views of the movable auxiliary sanitary care apparatus of the present invention, which is not in use and in use respectively. When the movable auxiliary sanitary care apparatus of the present invention is in use the outer lid 72 of the riding unit 7 is first lifted for user to sit on the seat cushion 71 to evacuate. After the user evacuates the user can operate the control panel 61 of the third shell body 6 to drive the cleaning nozzle unit 46 to extend correspondingly to clean the anal part of the user. At this moment the cleaning nozzle unit 46 cleans and undergoes germicidal treatment of the anal part of the user directly by means of the warm water of the water supply tank 33 and the built-in germicidal light source to achieve the substantial benefits of cleaning and antisepticising without wiping.

Referring the following processes, they are the operation steps of the present invention that the control unit 45 supplies warm water of the water supply tank 33 when warm water is delivered to the cleaning nozzle unit 46 for the user to clean.

(a) The user pushes the control panel 61 to turn on the control unit 45 and send a signal to drive the water supply device. After the warm water of the water supply tank is delivered to the cleaning nozzle unit 46 it goes on performing step (b);

(b) The control unit 45 transmits a signal to the liquid level detection device 32 to determine if the clean water of the reservoir container 31 is higher than the predetermined lower limit value. If the clean water is higher than the lower limit value, it goes on performing step (c). If the determination result is not higher than the lower limit value, it performs step (e);

(c) The control unit 45 transmits a signal to drive the pumping device to drive the pumping device to pump the clean water of the reservoir container 31 to the water supply tank 33. At the same time the control unit 45 drives the heating device to heat the clean water of the water supply tank 33 to a predetermined temperature to go on performing step (d);

(d) The control unit 45 transmits a signal to the liquid level detection device 32 to detect if the clean water of the reservoir container 32 is lower than a predetermined lower limit value. If the clean water has not reached the lower limit value, it goes on performing step (b). If the determination result has reached the lower than the lower limit value, it goes on performing step (e);

(e) If the clean water of the reservoir container 31 has reached the lower limit value, the control unit 45 transmits a warn signal and sound to the control panel 61. At the same time the power supply for the pumping device, water supply device and heating device are turned off and then goes on performing the determination program of step (f);

(f) The control unit 45 monitors the liquid level detection device 32 to determine if the clean water of the reservoir container 31 is higher than a predetermined lower limit value. If the clean water is higher than the lower limit value, it goes on performing step (a). If the determination result is not higher than the lower limit value, it goes on performing step (e).

Accordingly, by means of the movable sanitary auxiliary care apparatus of the present invention it takes advantage of the support unit 1 that its frame not only has the chair leg section 13 to position stably and moves conveniently and the protection of the exterior shape of the shell unit but also the control panel 61 of the third shell body 6 installed on the shell unit to drive the central processing unit which connects and controls all power sources such as the lifting unit 2, the pumping device of the reservoir container 31, the water supply device and heating device of the water supply tank 33, the germicidal light source of the cleaning nozzle unit 46, ejecting water and extending/retracting movement and the convenient electronic control of the toilet chair for lifting. Furthermore, when the riding unit 7 of the present invention is not in use, the design of the outer lid 72 covered by foam rubber and soft fabric can be used as a chair for user to achieve the substantial benefits of barrier free and multi-function so as to enhance the value of the industry application and market competition.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A movable auxiliary sanitary care apparatus, comprising:

a supporting unit which forms a storing space by frame;

a riding unit on which a user can be seated;

a lifting unit secured at the storing space, which is combined with the riding unit to drive the riding unit to descend or ascend with varying angle to provide additional support to assist the user in standing and exiting the apparatus, wherein the lifting unit further comprises:

a front fixing bracket and a rear fixing bracket both of which cross the supporting unit;

a balance rod and a driving rod which are installed between the front fixing bracket and the rear fixing bracket;

a power source connecting with the driving rod;

a movable member disposed between the balance rod and the driving rod; and a lever unit and a pushing member both of which are crossed and pivoted with each other at the front fixing bracket and the movable member to drive the movable member to move along the driving rod and the balance rod in a forward and backward movement after the driving rod is driven and rotated by the power source, at the same time the pushing member secured with a seat cushion of the riding unit being driven to ascend or descend gradually to help push the user to stand up from the seat and turn on the power source to lower down and restore at a horizontal close state when not in use; and a water supply unit having a cleaning nozzle unit which ejects water to clean an anal part of the user after evacuation; and a waste storing unit which collects and stores waste, wherein the seat cushion has a location restraining section formed on a lower surface corresponding with the pushing member to have the pushing member accommodated and restrained therein.

2. A movable auxiliary sanitary care apparatus as claimed in claim 1, wherein the water supply unit comprises:

a reservoir container provided with a water intake section to hold required clean water from the water intake section;

a liquid level detection device provided inside the reservoir container to measure and monitor a liquid level of the cleaning water continuously; and a water supply tank connected to the reservoir container with tubes.

3. A movable auxiliary sanitary care apparatus as claimed in claim 1, further comprising an outer shell unit including a first shell body and a second shell body to respectively cover top and bottom of the support unit, the first shell body provided with two slots and an aperture, wherein the slots are used to accommodate the pushing member of the lifting unit and the aperture is installed with a hollow guiding basin body; the second shell body providing with an opening at a front rim and a through hole on a lateral surface thereof to have the water intake section extend out of the shell body.

4. A movable auxiliary sanitary care apparatus as claimed in claim 3, wherein the cleaning nozzle unit is provided with a hole shaped slide path flowing toward inner side of the guiding basin body on top, which cooperates and corresponds with the guiding basin body and the aperture to let residue water drops flow into the guiding basin body from the hole shaped slide path after a nozzle rod of the cleaning nozzle unit is used and retracted.

5. A movable auxiliary sanitary care apparatus as claimed in claim 3, wherein an interior surface of the first shell body is provided with a control unit which is driven by a power supply and installed with a central processing unit, the cleaning nozzle unit is connected to a water supply tank with tubes.

6. A movable auxiliary sanitary care apparatus as claimed in claim 3, wherein the outer shell unit further comprises a third shell body covering an armrest section of the support unit, which is provided with a control panel connecting with a control unit, an emergency switch, a restoring switch and start switches.

7. A movable auxiliary sanitary care apparatus as claimed in claim 6, wherein the control panel drives a central processing unit to control water temperature of the water supply tank, modulates and controls the seat cushion to have warm effect and movements of a cleaning nozzle unit for extending, retracting and cleaning, monitors and warns the liquid level the clean water and liquid lever of a waste storing unit, wherein an emergency switch cuts off the power supply in emergency state and a restoring switch restores the electricity immediately when the emergency switch cuts off the power supply in emergency to lower down a lever unit, and the start switch drives the movable member on the driving rod to move horizontally in forward and backward via the power source connecting the central processing unit.

8. A movable auxiliary sanitary care apparatus as claimed in claim 1, wherein the seat cushion has soft material inside to cooperate with an outer lid of the riding unit to work as a chair when the seat cushion of the riding unit is not used.

9. A movable auxiliary sanitary care apparatus, comprising:

a support unit constructed by a frame to form an armrest section, a storage space for storing and a positioning and movable chair leg section;

a lifting unit secured at the storage space and combined with a seat cushion of a riding unit, which is provided:

a front fixing bracket and a rear fixing bracket both of which cross the supporting unit;

a balance rod and a driving rod which are installed between the front fixing bracket and the rear fixing bracket;

a power source connecting with the driving rod;

a movable member disposed between the balance rod and the driving rod; and a lever unit and a pushing member both of which are crossed and pivoted with each other at the front fixing bracket and the movable member to drive the movable member to move along the driving rod and the balance rod in a forward and backward movement after the driving rod is driven and rotated by the power source, at the same time the pushing member secured with a seat cushion of the riding unit being driven to ascend or descend gradually to help push the user to stand up from the seat and turn on the power source to lower down and restore at a horizontal close state when not use;

a water supply unit comprising a water reservoir container provided with a water intake section to hold required clean water from the water intake section; a liquid level detection device provided inside the reservoir container to measure and monitor a liquid level of the cleaning water continuously; and a water supply tank connected to the reservoir container with tubes;

an outer shell unit including a first shell body and a second shell body respectively to cover top and bottom of the support unit, the first shell body provided with two slots and an aperture, wherein the slots accommodate a location restraining section of the lever unit of the lifting unit and the aperture is installed with a hollow guiding basin body; the second shell body providing with an opening at a front rim and an through hole on a lateral surface to have the water intake section of the reservoir container extend out of the shell body;

the riding unit comprising an outer lid, wherein the seat cushion is pivoted with the outer lid and an opening on the seat cushion corresponding with the guiding basin body is formed and a location restraining section is formed on a lower surface of the seat cushion corresponding with the pushing member to have the pushing member accommodated and restrained therein corresponding with the lifting unit at both sides is provided to combine and position with the lifting unit; and a waste storing unit which is provided and entered into the storage space of the support unit from an opening of the second shell body to hold waste collectively when the waste falls toward the guiding basin body from the opening of the seat cushion.

10. A movable auxiliary sanitary care apparatus as claimed in claim 9, wherein the water supply unit further comprises a cleaning nozzle unit provided with a hole shaped slide path flowing toward an inner side of the guiding basin body on top which cooperates and corresponds with the guiding basin body and the aperture to let residue water drops flow into the guiding basin body from the hole shaped slide path after a nozzle rod of the cleaning nozzle unit is used and retracted.

11. A movable auxiliary sanitary care apparatus as claimed in claim 9, wherein an interior surface of the first shell body is provided with a control unit which is driven by a power supply and installed with a central processing unit inside, and a cleaning nozzle unit is connected to the water supply tank with tubes.

12. A movable auxiliary sanitary care apparatus as claimed in claim 9, wherein the outer shell unit further comprises a third shell body covering the armrest section of the support unit, which is provided with a control panel connecting with a control unit, an emergency switch, a restoring switch and start switches.

13. A movable auxiliary sanitary care apparatus as claimed in claim 12, wherein the control panel drives a central processing unit to control water temperature of the water supply tank, modulates and controls a seat cushion to have warm effect and movements of the cleaning nozzle unit for extending, retracting and cleaning, monitors and warns the liquid level of the clean water and liquid level of a waste storing unit, wherein the emergency switch cuts off the power supply in emergency state and the restoring switch restores the electricity immediately when the emergency switch cuts off the power supply in emergency to lower down the lever unit, and the start switch drives the movable member on the drive rod to move horizontally in forward and backward via the power source of the drive rod connecting the central processing unit.

14. A movable auxiliary sanitary care apparatus as claimed in claim 9, wherein the outer lid is provided with an auxiliary seat cushion section which is laid with soft material to cooperate with the outer lid to work as a chair when the seat cushion of the riding unit is not used.

15. A movable auxiliary sanitary care apparatus as claimed in claim 1, wherein the waste storing unit comprises a box body and a lid body with a slot to let the waste fall from the opening of the seat cushion toward the guiding basin body into the slot of the lid body and collect in the box body.

* * * * *